US010553138B2

(12) United States Patent
Chen et al.

(10) Patent No.: US 10,553,138 B2
(45) Date of Patent: Feb. 4, 2020

(54) SYSTEM AND METHOD OF AN ADAPTIVE DRIVING COMPENSATION FOR ENHANCING DISPLAY UNIFORMITY

(71) Applicant: Solomon Systech (Shenzhen) Limited, Shenzhen, Guangdong (CN)

(72) Inventors: Jun Chen, Hong Kong (HK); Cheung Fai Lee, Hong Kong (HK); Shu Shing Ching, Hong Kong (HK); Wai Keung Lau, Hong Kong (HK); Wing Chi Stephen Chan, Hong Kong (HK)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 0 days.

(21) Appl. No.: 15/955,776

(22) Filed: Apr. 18, 2018

(65) Prior Publication Data

US 2019/0325795 A1 Oct. 24, 2019

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/08* (2013.01); *G09G 2320/0233* (2013.01); *G09G 2320/0626* (2013.01)

(58) Field of Classification Search
CPC ..... G09G 3/006; G09G 3/20; G09G 2310/08
See application file for complete search history.

(56) References Cited

U.S. PATENT DOCUMENTS

2011/0012908 A1* 1/2011 Daly ..... G09G 3/006 345/581
2013/0329057 A1* 12/2013 Al-Dahle ..... H04N 17/00 348/189

* cited by examiner

*Primary Examiner* — Chun-Nan Lin

(57) ABSTRACT

Disclosed is a system and method of an adaptive driving compensation for enhancing display uniformity. Multiple input data patterns of the display panel are compared with image data by an image analyzing means or a user and thereby generate display control commands if non-uniformity in the display of image is detected by the image analyzing means or the user. A difference between pixel data associated with a current line and a preceding line is compared with a predefined threshold. A look up table (LUT) is scanned to add a compensation value on the pixel data the current line based upon the display control commands if the difference between the pixel data of the current line and the preceding line is greater than the predefined threshold or otherwise retain the original value of the said pixel data. The input data patterns with compensated pixel data or original pixel data is displayed.

13 Claims, 8 Drawing Sheets

SYSTEM AND METHOD OF AN ADAPTIVE DRIVING COMPENSATION FOR ENHANCING DISPLAY UNIFORMITY

TECHNICAL FIELD

The present application described herein, in general, relates to an electronic device display panel. In particular, the present application relates to a system and method of an adaptive driving compensation for enhancing display uniformity.

BACKGROUND

Recently, technological advanced display panels have been developed in order to cater numerous customer-centric applications. With the flourishing development in the technology of display panels, it is a market and customer demand for high performance display panels. The display panels providing high resolution, high brightness and low-power consumption are most preferred. However, it is observed that, non-uniformities in brightness have been a critical quality issue impending the design, especially when the panel load increases. The behavior of Vcom (common voltage)/source/gate is unequal between touch and display of the display panel. The left or right Vcom path resistance is unequal. Further, Vcom resistances differ at near-display driver IC side and away-display driver IC side. Further, brightness differs due to the panel loading difference between display interval and interval after the blanking time. Therefore, there is long standing need of a system and method of an adaptive driving compensation for enhancing display uniformity.

SUMMARY

This summary is provided to introduce concepts related to a system and method for enhancing display uniformity and the concepts are further described below in the detailed description. This summary is not intended to identify essential features of the claimed application nor is it intended for use in determining or limiting the scope of the claimed application.

In one embodiment, a system of an adaptive driving compensation for enhancing display uniformity is disclosed. The system may include a display panel, and an image analyzing means. The image analyzing means or a user may be configured to compare a plurality of input data patterns of the display panel with an image data, wherein the image data is captured via an image capturing means or the user. The image analyzing means or the user may be further configured to generate a display control commands based upon the comparison of the plurality of input data patterns of the display panel with the image data, wherein the display control commands may be indicative of a compensation of one or more parameters associated with the display panel. The system may further include a display driver comprising a display control engine. The display control engine may further include a display controller and a memory. The memory may be configured to store the plurality of input data patterns corresponding to N lines of the display panel, wherein the plurality of input data comprises pixel data corresponding to each N lines for each display time interval. The display controller may be configured to receive the display control commands from the image analyzing means or the user, and pixel data associated with the plurality of input data patterns corresponding to N lines from the memory. The display controller may further be configured to compare a difference between pixel data associated with a pixel of a current line, of the N lines of the display panel, and pixel data associated with a corresponding pixel of a preceding line, of the N lines of the display panel, corresponding to a current display time interval with a predefined threshold. The display controller may further be configured to scan a look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold or otherwise retain the original value of the said pixel data. The display panel may be configured to display the input data patterns corresponding to the current line, wherein each input pattern corresponding to the current line being displayed comprises the pixel data with the compensated value or the original value.

In one embodiment, a method of an adaptive driving compensation for enhancing display uniformity is disclosed. The method may include comparing, via an image analyzing means or a user, a plurality of input data patterns of a display panel with an image data, wherein the image data is captured via an image capturing means or the user. The method may further include generating, via the image analyzing means or the user, a display control commands based upon the comparison of the plurality of input data patterns of the display panel with the image data, wherein the display control commands may be indicative of a compensation of one or more parameters associated with the display panel. The method may further include storing, via a memory, the plurality of input data patterns corresponding to N lines of the display panel, wherein the plurality of input data comprises pixel data corresponding to each N lines for each display time interval. The method may further include receiving, via a display controller, the display control commands from the image analyzing means or the user, and pixel data associated with the plurality of input data patterns corresponding to N lines from the memory. The method may further include comparing, via the display controller, a difference between pixel data associated with a pixel of a current line, of the N lines of the display panel, and pixel data associated with a corresponding pixel of a preceding line, of the N lines of the display panel, corresponding to a current display time interval with a predefined threshold. The method may include scanning, via the display controller, a look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold or otherwise retain the original value of the said pixel data. The method may further include displaying, via the display panel, the input data patterns corresponding to the current line, wherein each input pattern corresponding to the current line being displayed comprises the pixel data with the compensated value or the original value.

In one embodiment, a display driver of an adaptive driving compensation for enhancing display uniformity is disclosed. The display driver may include a display control engine. The display control engine may further include a display controller and a memory. The display driver may be electronically coupled with a display panel and an image analyzing means or a user. The memory may be configured to store a plurality of input data patterns corresponding to N lines of the display panel, wherein the plurality of input data comprises pixel data corresponding to each N lines for each display time interval. The display controller may be configured to receive a display control commands from the image analyzing means or a user, and a pixel data associated with the plurality of input data patterns corresponding to N lines from the memory, wherein the display control commands may be indicative of a compensation of one or more parameters associated with the display panel. The display controller may further be configured to compare a difference between pixel data associated with a pixel of a current line, of the N lines of the display panel, and pixel data associated with a corresponding pixel of a preceding line, of the N lines of the display panel, corresponding to a current display time interval with a predefined threshold. The display controller may further be configured to scan a look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold or otherwise retain the original value of the said pixel data.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1A:
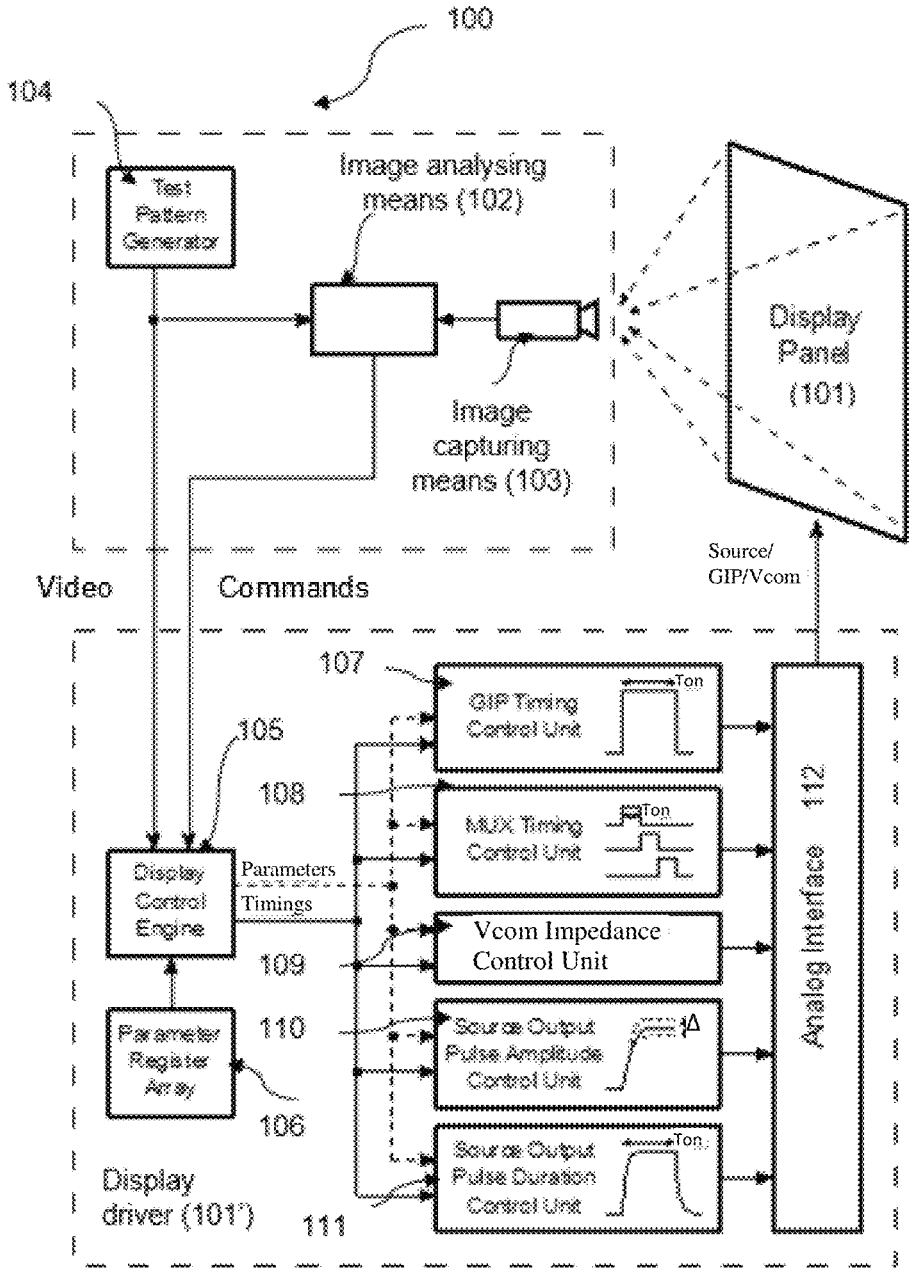
FIG. 1(A) and FIG. 1(B) illustrate a block diagram depicting components of a system 100 enabling an adaptive driving compensation for enhancing display uniformity, in accordance with embodiments of the present application.
Figure 1B:
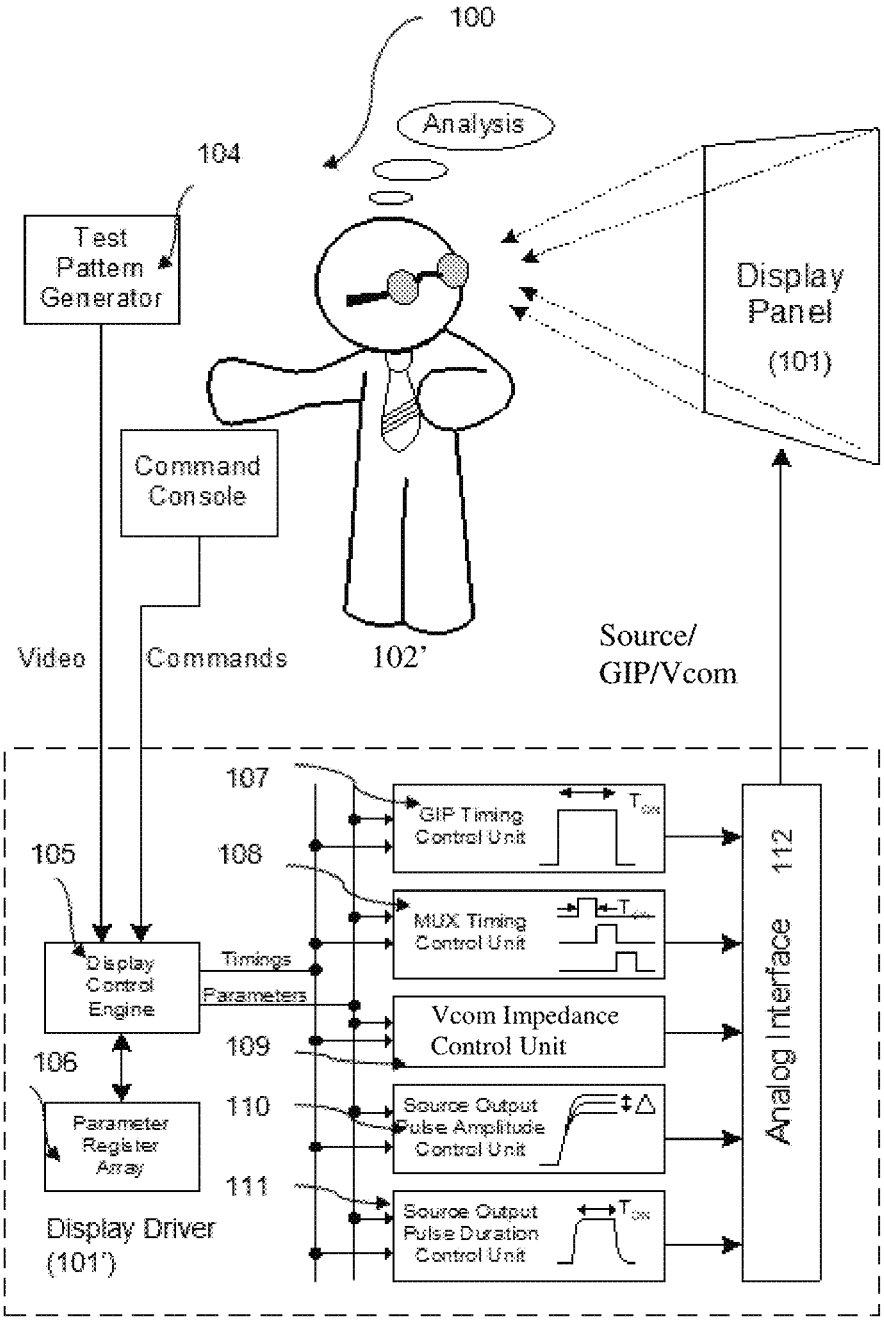

Now referring to FIG. 1(A) and FIG. 1(B), a block diagram depicting components of a system 100 of an adaptive driving compensation for enhancing display uniformity is illustrated in accordance with embodiments of the present disclosure. Referring FIG. 1(A), the system 100 of the adaptive driving compensation for enhancing display uniformity is illustrated in accordance with one embodiment of the present disclosure. In this embodiment, the system 100 may include a display panel 101, an image analyzing means 102, and a display driver 101'. In one embodiment, the display driver 101' may further include a display control engine 105, a parameter register array 106, a GIP (Gate-In-Panel) timing control unit 107, a MUX (Multiplexer) timing control unit 108, a Vcom impedance control unit 109, a source output pulse amplitude control unit 110, a source output pulse duration control unit 111, and an analog interface 112. In one embodiment, the display panel 101 may be a device under test. In one embodiment, each display panel may have slight variations in electrical and mechanical properties which may affect display uniformity and color tone accuracy (i.e. display quality in general). In one embodiment, the system 100 may further include a test pattern generator 104 and an image capturing means 103. In one embodiment, the test pattern generator 104 and the image capturing means 103 may be electronically coupled to the display driver 101'. In one embodiment, the image capturing means 103 may capture an image data reproduced by the display panel 101. In one embodiment, the test pattern generator 104 may configured to generate a plurality of input data patterns of the display panel 101. In one embodiment, the plurality of input data patterns of the display panel may be a video data. In one embodiment, the image analyzing means 102 may be configured to compare the plurality of input data patterns of the display panel 101 with the image data. The image analyzing means 102 may be further configured to generate a display control commands based upon the comparison of the plurality of input data patterns of the display panel with the image data. In one embodiment, the display control commands may indicative of a compensation of one or more parameters associated with the display panel.

Now referring to FIG. 1(B), the system 100 of the adaptive driving compensation for enhancing display uniformity is illustrated in accordance with another embodiment of the present disclosure. In this embodiment, the system 100 may include a display panel 101, a user 102', and a display driver 101'. In one embodiment, the display driver 101' may further include a display control engine 105, a parameter register array 106, a GIP timing control unit 107, a MUX timing control unit 108, a Vcom impedance control unit 109, a source output pulse amplitude control unit 110, a source output pulse duration control unit 111, an analog interface 112. In one embodiment, the display panel 101 may be a device under test. In one embodiment, each display panel may have slight variations in electrical and mechanical properties which may affect display uniformity and color tone accuracy (i.e. display quality in general). In one embodiment, the system 100 may further include the test pattern generator 104. In one embodiment, the user 102' may capture the image data reproduced by the display panel 101. In one embodiment, the user 102' may be a human. In one embodiment, the user 102' may use his/her vision to capture/see the image data reproduced by the display panel 101. In one embodiment, the test pattern generator 104 may configured to generate a plurality of input data patterns of the display panel 101. In one embodiment, the plurality of input data patterns of the display panel may be a video data. In one embodiment, the user 102' may use his/her intellect to compare the plurality of input data patterns of the display panel 101 with the image data. Further, the user 102' may send a display control commands based upon the comparison of the plurality of input data patterns of the display panel with the image data. In one embodiment, the user 102' may send display control command to the display control engine 105 via an Input/output interface of the display driver 101'. In one embodiment, the display control commands may indicative of a compensation of one or more parameters associated with the display panel.

Now referring to both FIG. 1(A) and FIG. 1(B), the display control engine 105 may be configured to receive the display control commands. In one embodiment, the display control engine 105 may decode the display control commands and convert the display commands decoded into control signals and timing information to compensate driving values of the display panel 101. Further, the display control engine 105 may receive the plurality of input data patterns of the display panel 101. In one embodiment, the display control engine 105 may compensate one or more parameters of the plurality of input data patterns of the display panel based upon the display control commands. In one embodiment, the one or more parameters may be adjusted to achieve decent display uniformity and color tone accuracy. In one embodiment, a control unit or control circuitry corresponding to each parameter from one or more parameters may perform adjustment of one or more parameters. In one embodiment, the GIP timing control unit 107 may be configured to adjust "effective thin film transistor (TFT) ON time" per row (horizontal line) in order to perform compensation of the GIP timing. The MUX timing control unit 108 may be configured to adjust "effective thin film transistor (TFT) ON time" per row in order to compensate the MUX timing. Further, the MUX timing control unit may control the timing of the whole row, therefore the MUX timing control unit 108 may still adjust the effective "ON time" per row. The Vcom impedance control unit 109 may be configured to compensate loading difference of Vcom in different regions of a panel. In one embodiment, the Vcom impedance control unit 109 may be configured to compensate impedance differences in driving far away and nearby pixels. The Vcom impedance control unit 109 may be configured to compensate impedance differences in driving left and right panel pixels. The source output pulse amplitude control unit 110 may be configured to compensate various imperfections including display driving mode and touch sensing mode time multiplexing by compensating the amplitude of the original source output signal. The source output pulse duration control unit 111 may be configured to compensate various imperfections including display driving mode and touch sensing mode time multiplexing compensating the duration of the original source output signal. In one embodiment, the analog interface 112 may be configured to be electronically coupled with the display panel 101.

In one embodiment, the display driver 101' may further include the parameter register array 106 in order to store various compensation parameters. In one embodiment, the compensation parameters may be stored in the digital form. The compensation parameters may be different for each display panel as each display panel may have different electrical and mechanical properties. In one embodiment, the compensation may be an iterative process. In one embodiment, the system 100 may recapture the images reproduced by the display panel 101 after adjustment of the compensation parameters. If the results are satisfactory, the adjustment stops. If the results are not satisfactory, the system 100 may perform adjustment for the display panel until the display panel performance captured is satisfactory. The details of the iterative compensation process implemented by the system are described hereinafter in subsequent paragraphs.

Figure 2:
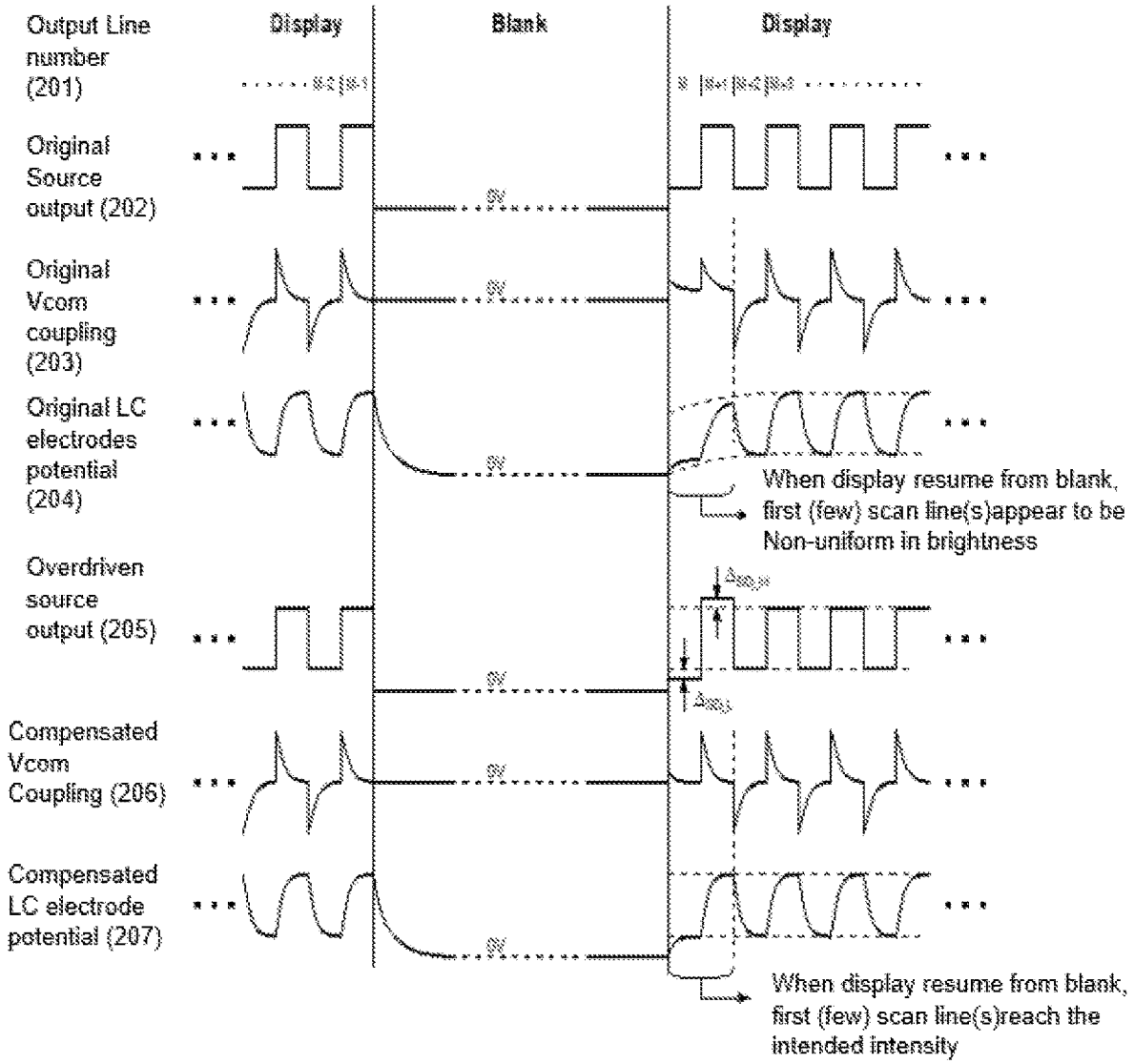
FIG. 2 illustrates waveforms of non-adaptive and adaptive driving compensation for Vcom at display lines after the blanking time interval, in accordance with an embodiment of the present application.

Now referring to FIG. 2 waveforms of non-adaptive and adaptive driving compensation for Vcom at display lines after the blanking time interval are illustrated, in accordance with an embodiment of the present application. FIG. 2 depicts output line numbers 201, original source output 202, original Vcom coupling 203, original LC (Liquid Crystal) electrodes potential 204 for non-adaptive driving compensation. In one embodiment, the output line numbers are a display scanning line numbers wherein the display scanning line numbers may be indicated by the series of M. In one embodiment, at a first display time interval, the above-mentioned signals may have maximum amplitudes. In one embodiment, M−2, and M−1 are the display scanning lines in the first display time interval. Further, in the successive blanking time interval of the display panel, the said signals may be absent or switched off. In one embodiment, the original source output 202, the original Vcom coupling 203 may be static during the blanking time interval. In one embodiment, M is the output line number, where display scanning may be resumed from the blanking time interval. In one embodiment, the M may be single blank/touch pause after the blanking time interval. In another embodiment, the M, M', M" . . . etc. may be the multiple blank/touch pauses per frame after the blanking time interval. In one embodiment, the N may be the number of lines rescanned when the display scanning resumes at any line number M after blank/touch pause. In one embodiment, the first few display lines of the original source output 202, the original Vcom coupling 203 may take time to resume after the blanking time interval i.e. at a second display time interval of the display panel 101. In one embodiment, the potential difference between LC electrodes may be distorted for the first scan lines of the display panel 101 at the second display time interval after the blanking time interval. In one embodiment, the first few scan lines for M, M+1 at the second display time interval may appear to be non-uniform in brightness.

Further, referring FIG. 2, an overdriven source output 205, compensated Vcom coupling 206, compensated LC electrodes potential 207 for adaptive driving compensation is depicted. In one embodiment, the display driver 101' (as shown in FIGS. 1(A) and 1(B)) may compensate the original source output 202, the original Vcom coupling 203 and the original LC electrodes potential 204 to obtain the overdriven source output 205, the compensated Vcom coupling 206 and the compensated LC electrodes potential 207 respectively. In one embodiment, the source amplitude of the first few display lines of original source output 202 may be compensated with $\Delta_{SD}$ after the blanking time interval. As shown, the overdriven source output 205 depicts the original source output 202 being compensated with the value $\Delta_{SD}$ In one embodiment, $\Delta_{SD_H}$ and $\Delta_{SD_L}$ may represent the Source amplitude compensation value at the start of the display time interval. The original Vcom coupling 203 may be compensated at first few display lines after the blanking time interval to obtain the compensated Vcom coupling 206. The original LC electrodes potential 204 may be compensated at first few display lines after the blanking time interval to obtain the compensated LC electrodes potential 207. In one embodiment, the potential difference on two terminal LCs may not distort at first few lines of the second display time interval. In one embodiment, the first few scan lines for M, M+1 at the second display time interval may appear to be uniform in brightness (intended intensity) after compensation.

Figure 3:
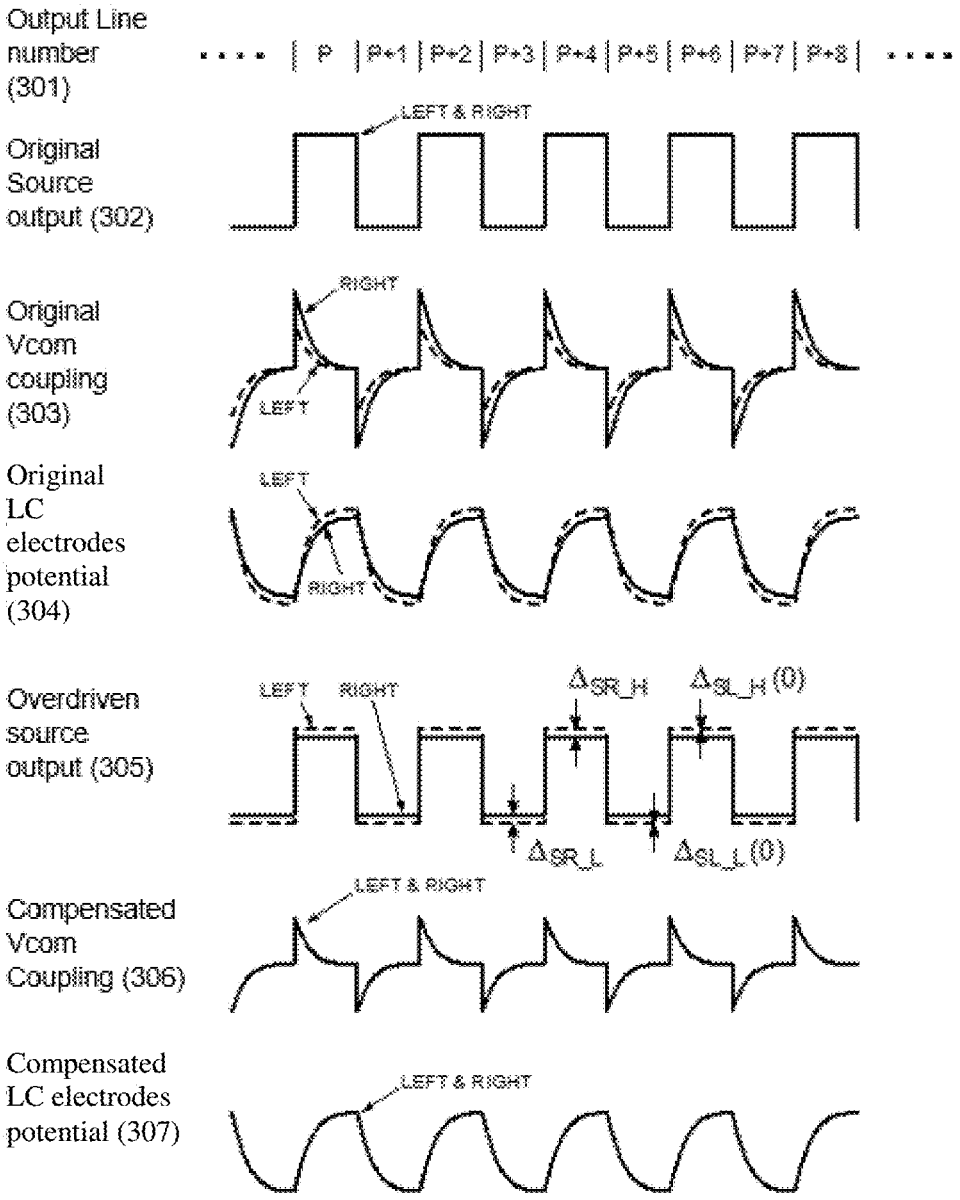
FIG. 3 illustrates waveforms of non-adaptive and adaptive driving compensation for Vcom of the display panel wherein display lines are split along the center, in accordance with an embodiment of the present application.

Now referring to FIG. 3 waveforms of non-adaptive and adaptive driving compensation for Vcom of display panel wherein display lines are split along the center are illustrated, in accordance with an embodiment of the present application. FIG. 3 depicts output line numbers 301, original source output 302, original Vcom coupling 303, original LC electrodes potential 304 for non-adaptive driving compensation. In one embodiment, output line numbers 301 may output scanning line number on the panel. In one embodiment, the output scanning line number on the panel may be represented by the series of P. As shown, the original source output 302 may depict at left and right of the display panel. In one embodiment, each line of the display panel may comprise source amplitude for left-hand side (LHS) and right-hand side (RHS) panel. In one embodiment, the waveform of original Vcom coupling 303, waveform of an original LC electrode potential 304 and waveform of an overdriven source output 305 may comprises RHS waveform and LHS waveform. The RHS waveform may be represented by the solid line. The LHS waveform may be represented by the dotted line. In one embodiment, the waveform of original Vcom coupling 303 may represent the difference between the LHS and the RHS panel due to different Vcom loading. In one embodiment, the resistance and capacitance of the LHS and the RHS panel may not be 100 percent matched. In one embodiment, waveform for original LC electrode potential 304 may represent difference between LHS and RHS panel in the potential across the LC. In one embodiment, the brightness of LHS and RHS panel may be different (i.e. non-uniform).

Further, referring FIG. 3, an overdriven source output 305, compensated Vcom coupling 306, compensated LC electrodes potential 307 for adaptive driving compensation is depicted. In one embodiment, waveforms of the overdriven source output 305 may represent compensation of the source output voltages corresponding to RHS by $\Delta_{SR_H}$ and $\Delta_{SR_L}$ in order to reduce the RHS source amplitude adaptively. In one embodiment, the waveforms of the overdriven source output 305 corresponding to LHS may be retained and hence the compensation of the source output voltages for the LHS may be represented as $\Delta_{SL_H}$ and $\Delta_{SL_L}=0$. The waveforms of the compensated Vcom coupling 306 may represent compensated amplitude of the Vcom coupling. The waveforms of the compensated LC electrodes potential 307 may represent zero difference between LHS and RHS panel in the potential across the LC. In one embodiment, the brightness of LHS and RHS panel may be same (i.e. uniform).

Figure 4:
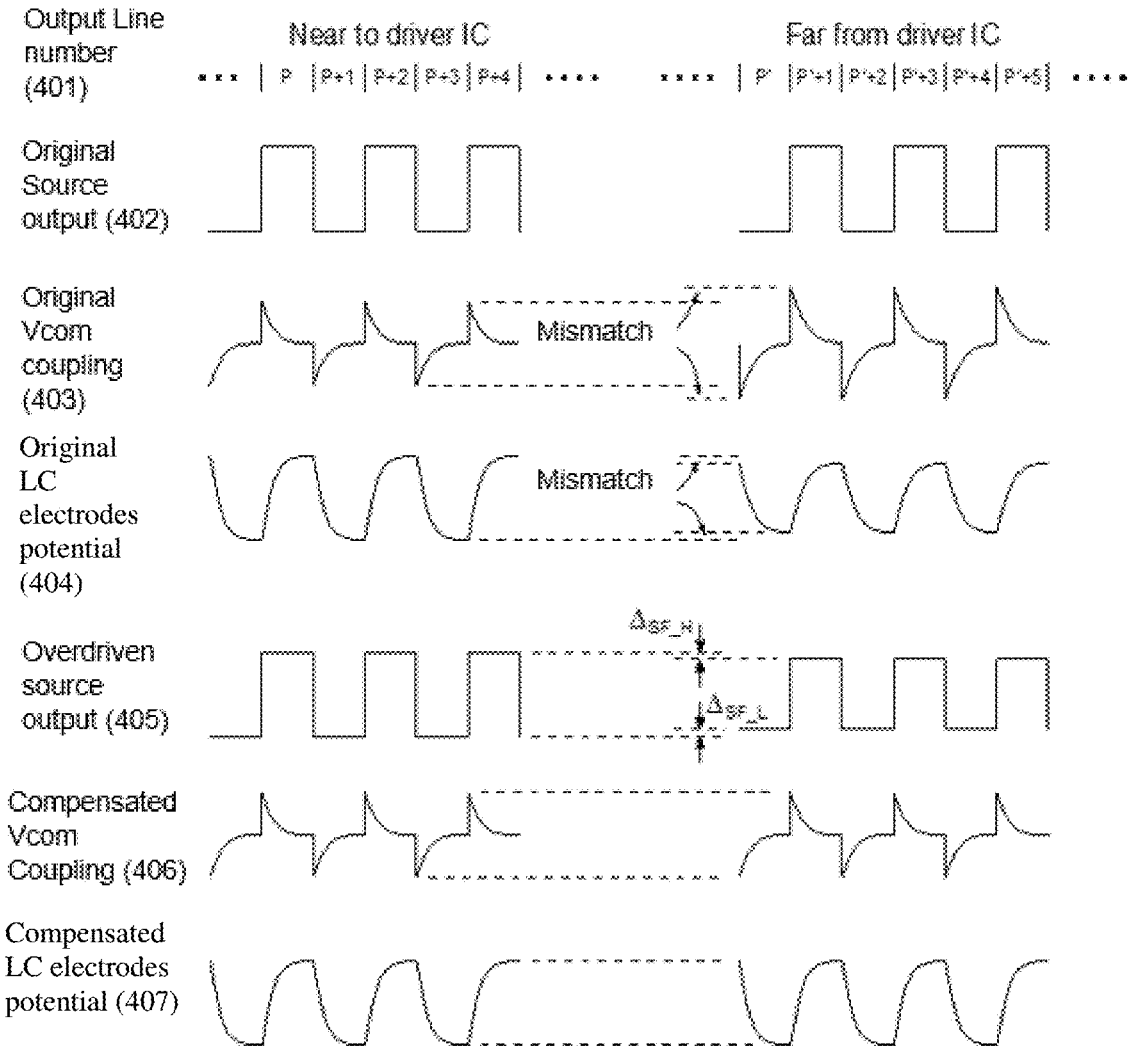
FIG. 4 illustrates waveform of non-adaptive and adaptive driving compensation for Vcom of the display panel wherein display color shifts along the scan direction, in accordance with an embodiment of the present application.

Now referring to FIG. 4 waveforms of non-adaptive and adaptive driving compensation for Vcom of the display panel wherein display color is shifted along the scan direction are illustrated, in accordance with an embodiment of the present application. FIG. 4 depicts output line numbers 401, original source output 402, original Vcom coupling 403, original LC electrodes potential 404 for non-adaptive driving compensation. In one embodiment, the output line numbers 401 may be represented by the series of P and P'. In one embodiment, the P may represent scanning lines near to the driver IC. In one embodiment, the P' may represent scanning lines far away from the driver IC. In one embodiment, the original source output 402 may depict at region near to display driver 101' and at region far from the display driver 101'. In one embodiment, waveform of the original Vcom coupling 403 may represent the difference between the region near to display driver 101' and the region far to display driver 101' due to different Vcom loading. In one embodiment, the resistance and capacitance of the region far from the display driver 101' is larger than the resistance and capacitance of the region near the display driver 101'. In one embodiment, waveform for the original LC electrodes potential 404 may represents difference between the region far to the display driver 101' and the region near to display driver in the potential across the LC. In one embodiment, the brightness of the display panel region far to display driver 101' and the display panel region near to display driver 101' may be different (i.e. non-uniform).

Further, referring FIG. 4, an overdriven source output 405, compensated Vcom coupling 406, compensated LC electrodes potential 407 for adaptive driving compensation is depicted. In one embodiment, waveforms of the overdriven source output 405 of the display panel far from the display driver 101' may represent compensation of the source output voltages of the original source output 402 of the display panel far the display driver by $\Delta_{SF_H}$ and $\Delta_{SF_L}$ in order to reduce the source amplitude adaptively. The waveforms of the compensated Vcom coupling 406 may represent compensated amplitude of the original Vcom coupling. In one embodiment, waveforms of the compensated LC electrode potential 407 may represent zero difference between display panel region far to display driver and display panel region near to the display driver in the potential across the LC. In one embodiment, the brightness of display panel region far to display driver and display panel region near to display driver may be same (i.e. uniform).

Figure 5:
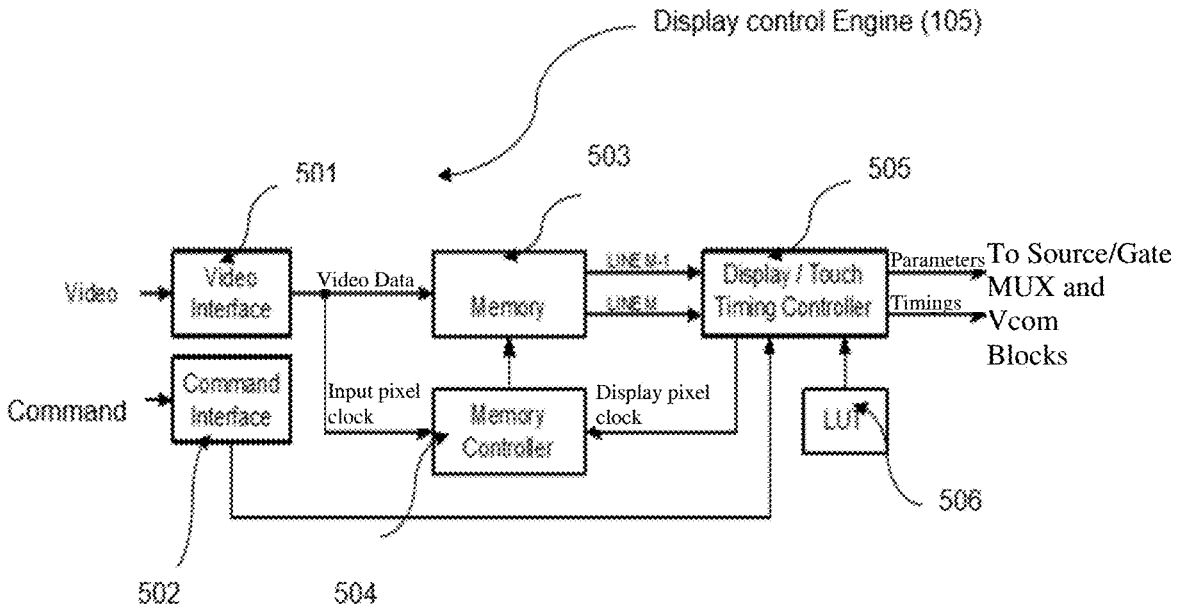
FIG. 5 illustrates a circuit implementation diagram of a display control engine 105 enabling an adaptive driving compensation for enhancing display uniformity, in accordance with an embodiment of the present application.
Figure 6:
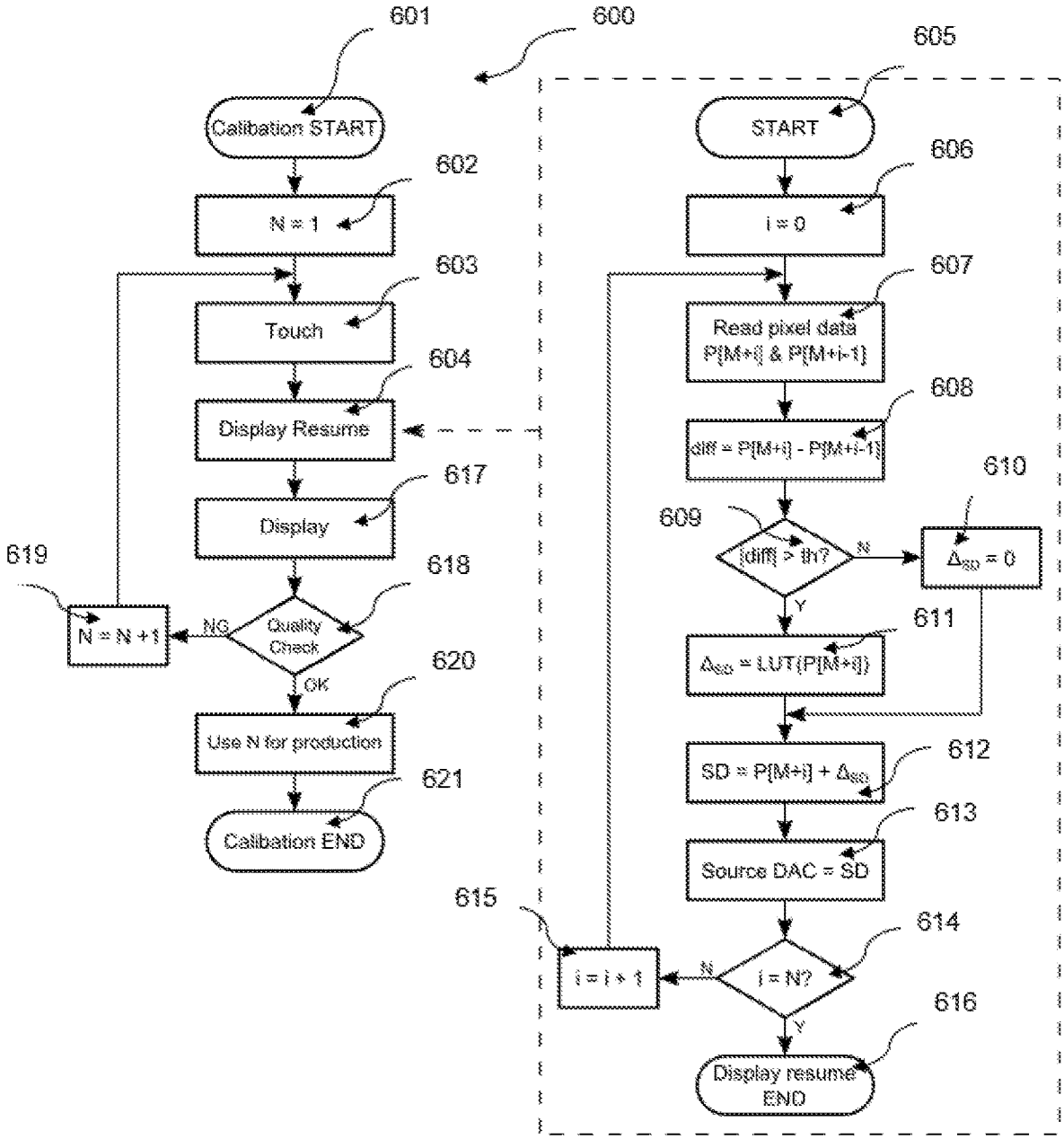
FIG. 6 illustrates a flowchart for adaptive driving compensation, in accordance with an embodiment of the present application.

Now referring to FIG. 5, a circuit implementation diagram of the display control engine 105 enabling an adaptive driving compensation for enhancing display uniformity is illustrated. In one embodiment, the display control engine 105 (as shown in FIGS. 1(A), 1(B) and 5) may include a video interface 501, a command interface 502, a memory 503, a memory controller 504, a display controller 505, and a look up table (LUT) 506. In one embodiment, the video interface 501 may be configured to receive the plurality of input data patterns corresponding to N lines of the display panel 101. In one embodiment, the test pattern generator 104 (shown in FIGS. 1(A) and 1(B)) may generate the plurality of input data patterns corresponding to N lines of the display panel. In one embodiment, the memory 503 may store the plurality of input data patterns corresponding to N lines of the display panel. In one embodiment, the plurality of input data patterns corresponding to N lines of the display panel may be video data. In one embodiment, the plurality of input data comprises pixel data corresponding to each N lines for each display time interval. In one embodiment, the memory controller 504 may be configured to read/write the memory 503. In one embodiment, the memory controller 504 may be configured to receive DISPLAY PIXEL CLK from the display controller 505 and the input pixel clock from video interface 501. In one embodiment, the display controller 505 may read a pixel data associated with a pixel of a current line, of the N lines of the display panel, and a pixel data associated with a corresponding pixel of a preceding line, of the N lines of the display panel. In one embodiment, the display controller 505 may compare the difference between the pixel data associated with the pixel of the current line, of the N lines of the display panel, and the pixel data associated with a corresponding pixel of a preceding line, of the N lines of the display panel, corresponding to a current display time interval with the predefined threshold. In one embodiment, the display controller 505 may receive the display control commands from the command interface 502. The command interface 502 may be configured to receive the display control commands from the image analyzing means 102 or a user 102'. The display controller 505 may scan the look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold. Alternatively, if the difference between the pixel data associated with each pixel of the current line and the pixel data associated with the corresponding pixel of the preceding line is less than or equal to the predefined threshold, the display controller 505 may retain the original value of the said pixel data associated with the corresponding pixel of the current line of the N lines of the display panel 101.

In one embodiment, the predefined threshold may be an 8-bit register representing 0~255 levels. The predefined threshold may be adjusted according to characteristics of the display panel 101. In one exemplary embodiment, the value of the predefined threshold may be large for small loading panels therefore, the data compensation may not be required for the plurality of input data pattern for the small loading panels. In one exemplary embodiment, the value of the predefined threshold may be small for heavy loading panels therefore, the data compensation may be required for the plurality of input data pattern for the heavy loading panels.

In one embodiment, the look up table 506 utilized for the compensation value may be a hardware-friendly implementation of the input data processing. Typically, according to the experience of human eyes' sensitivity to different levels of gamma curve, a gamma curve with 256 levels are divided to 5 regions (0~63, 64~111, 112~143, 144~191, 192~255), where the region divisions near 0 or 255 are coarse and the region divisions near 128 are fine. This is because human eyes are less sensitive to dark/bright levels and sensitive to mid-levels of gamma curve.

Depending on the values of pixel data associated with the pixel of the current line, of the N lines of the display panel, a data processing unit (Not shown in the Fig.) associated with the display controller may search for the compensation values in the look up table 506. The compensation values may be implemented as 9-bit registers (MSB is + or −, the other 8 bits represents 256 levels). The compensation values for regions near 0 or 255 are relatively large, values for regions near 128 are relatively small as human eyes are less sensitive to dark/bright levels and are sensitive to mid-levels of gamma curve. Now referring table 1 below the compensation value for 256 levels in the five 9-bit registers is depicted.

TABLE 1

| Data of current Line | Compensation (five 9-bit registers) | Application example of compensation values |
|---|---|---|
| 0 . . . 63 | $\Delta_{SD_L}$ | −30 |
| 64 . . . 111 | $\Delta_{SD_ML}$ | −20 |
| 112 . . . 143 | $\Delta_{SD_M}$ | 0 |
| 144 . . . 191 | $\Delta_{SD_MH}$ | +20 |
| 192 . . . 255 | $\Delta_{SD_H}$ | +30 |

Now, referring to FIG. 1(A), 1(B), FIG. 5, and FIG. 6, the display controller 505 may receive the display control commands from the image analyzing means 102 or the user based upon the comparison of the plurality of input data patterns of the display panel with the image data. In one embodiment, if the image analyzing means 102 or the user identifies the poor performance of the display panel 101 based upon the comparison of the plurality of input data patterns of the display panel with the image data, then the image analyzing means 102 or the user may be configured to generate the display control commands indicative of a compensation of one or more parameters associated with the display panel 101. Now referring to FIG. 6, at step 601, compensation or calibration procedure may be initiated. At step 602, the display control engine 105 may trigger scanning of the first line i.e. N=1 of the N lines of the display panel 101. In one embodiment, N may be the number of lines rescanned when the display scanning resume at any line number M after blank/touch pause. At step 603, the display controller 505 may execute instructions to stop working of display panel and activate touch sensor for a time period. At step 604, the display controller 505 may execute instructions to start the working of the display panel i.e. display resume. Therefore, there may be panel loading difference at the boundaries of 603 and 604. In one embodiment, at step 605, the display resume may be initiated. At step 606, the display controller 505 may start at i=0 of N line stored in the memory 503. At step 607, the display controller 505 may read the pixel data associated with the pixel of the current line (M+i), of the N lines of the display panel, and the pixel data associated with the corresponding pixel of a preceding line (M+i−1), of the N lines of the display panel. At step 608, the display controller 505 may compute the difference between the line (M+i) and the preceding line (M+i−1). At step 609, the display controller 505 may check whether the absolute difference between the pixel data associated with the pixel of the current line (M+i), of the N lines of the display panel, and the pixel data associated with the corresponding pixel of a preceding line (M+i−1), of the N lines of the display panel exceeds or greater than the predefined threshold. If the absolute difference between the pixel data associated with the pixel of the current line (M+i) and the pixel data associated with the corresponding pixel of a preceding line (M+i−1) is greater than the predefined threshold, then at step 611, the display controller 505 may search for source amplitude compensation value ($\Delta_{SD}$) at the start of the current display time interval based on the display control command Δt step 612, the display controller 505 may add the $\Delta_{SD}$ on the pixel data associated with the pixel of the current line (M+i). If the absolute difference between the pixel data associated with the pixel of the current line (M+i) and the pixel data associated with the corresponding pixel of a preceding line (M+i−1) is not greater than the predefined threshold, then at step 610, the display controller 505 may set the value of $\Delta_{SD}$=0 and proceeds to step 612. In one embodiment, the $\Delta_{SD}$ may be in the data in the digital form. At step 613, the display controller 505 may convert the digital data into analog timing and parameter control signals.

At step 614, the display controller 505 may check whether i=N. If 'i' is not equal to N, then at step 615, the display controller 505 may increment the value of 'i' by 1 and the steps from 607 to 614 are repeated for the line i+1. If i=N, then at step 616, the display controller 505 may end the procedure of the step 604 and return at the step 604. At step 617, the display driver may display the input data pattern corresponding to N lines of the display panel. At step 618, the system may perform display quality check. Image appearing on the display panel 101 is captured by the image capturing means 103 or checked by the user and then analyzed by the image analyzing means 102 or by the user. If the quality of the input data pattern is not good (NG) then at step 619, the system may increment the line N by 1 and goes back to step 603. If the input data pattern is OK then at step 620, the system will record the value of N which is the parameter for the display resume process 604 for good display quality. At step 621, the system may end the calibration process and the value N obtained in step 620 will be used for production. In one embodiment, the system 100 may iteratively generate display control commands in order to iteratively compensate the pixel data value until the display patterns between two display time intervals are uniformly displayed. In one embodiment, the uniformity of the display may be confirmed by the image analyzing means 102 or by the user.

Figure 7:
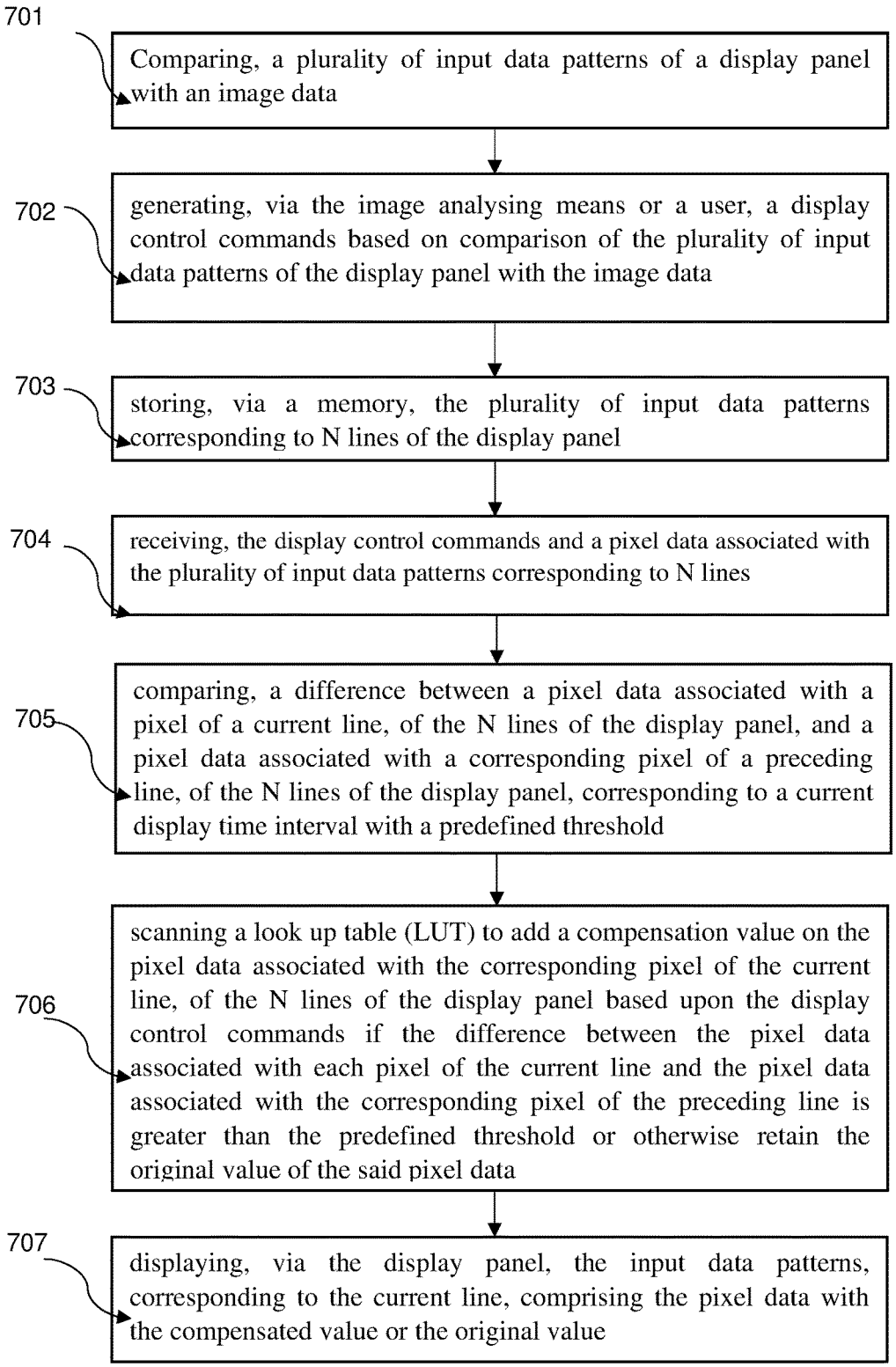
FIG. 7 illustrates a step wise flowchart depicting a method of an adaptive driving compensation for enhancing display uniformity, in accordance with an embodiment of the present application.

Now referring to FIG. 7, a method of an adaptive driving compensation for enhancing display uniformity is illustrated, in accordance with an embodiment of the present application.

At step 701, the image analyzing means 102 or the user 102' may compare the plurality of input data patterns of the display panel 101 with an image data, wherein the image data is captured by the image capturing means 103 or the user 102'.

At step 702, the image analyzing means 102 or the user 102' may generate display control commands based upon the comparison of the plurality of input data patterns of the display panel 101 with the image data. In one embodiment, the display control commands may be indicative of a compensation of one or more parameters associated with the display panel 101.

At step 703, the memory 503 may store the plurality of input data patterns corresponding to N lines of the display panel 101. In one embodiment, the plurality of input data comprises pixel data corresponding to each N lines for each display time interval.

At step 704, the display controller 505 may receive the display control commands from the image analyzing means 102 or a user 102' and the pixel data associated with the plurality of input data patterns corresponding to N lines from the memory 503.

At step 705, the display controller 505 may compare the difference between a pixel data associated with a pixel of a current line, of the N lines of the display panel, and a pixel data associated with a corresponding pixel of a preceding line, of the N lines of the display panel, corresponding to the current display time interval with a predefined threshold.

At step 706, the display controller 505 may scan the look up table (LUT) to add the compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold. Alternatively, if the difference between the pixel data associated with each pixel of the current line and the pixel data associated with the corresponding pixel of the preceding line is not greater than the predefined threshold, the display controller 505 may retain the original value of the said pixel data associated with the corresponding pixel of the current line.

At step 707, the display panel 101 may display the input data patterns corresponding to the current line, wherein each input pattern corresponding to the current line being displayed comprises the pixel data with the compensated value or the original value.

Although implementations for a system and method of an adaptive driving compensation for enhancing display uniformity have been described in language specific to structural features and/or methods, it is to be understood that the appended claims are not necessarily limited to the specific features or methods described. Rather, the specific features and methods are disclosed as examples of implementations for a system and method of an adaptive driving compensation for enhancing display uniformity.

What is claimed is:

1. A system of an adaptive driving compensation for enhancing display uniformity, the system comprising:

a display panel;

a processor; and a display driver;

wherein the processor is configured to compare a plurality of input data patterns of the display panel with an image data, wherein the image data is captured via an image capturing means, and generate display control commands based upon comparison of the plurality of input data patterns of the display panel with the image data, wherein the display control commands are indicative of a compensation of one or more parameters associated with the display panel; and wherein the display driver comprises a display control engine comprising a display controller and a memory, wherein the memory is configured to store the plurality of input data patterns corresponding to N lines of the display panel, wherein the plurality of input data comprises pixel data corresponding to each N lines for each display time interval; and wherein the display controller is configured to receive the display control commands from the processor, and pixel data associated with the plurality of input data patterns corresponding to N lines from the memory, compare a difference between pixel data associated with a pixel of a current line, of the N lines of the display panel, and pixel data associated with a corresponding pixel of a preceding line, of the N lines of the display panel, corresponding to a current display time interval with a predefined threshold, and scan a look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold or otherwise retain the original value of the said pixel data; and wherein the display panel is configured to display the input data patterns corresponding to the current line, wherein each input pattern corresponding to the current line being displayed comprises the pixel data with the compensated value or the original value;

wherein the one or more parameters comprises an amplitude of an original source output signal; and the display driver is configured to compensate imperfections including display driving mode and touch sensing mode time multiplexing by compensating the amplitude of the original source output signal.

2. The system of claim 1, wherein the one or more parameters further comprises a Gate-In-Panel (GIP) timing, a Multiplexer (MUX) timing, a common voltage (Vcom) impedance, and a duration of the original source output signal.

3. The system of the claim 2, wherein the display driver is configured to adjust an effective "Thin Film Transistor (TFT) ON time" per row to compensate the GIP timing and the MUX timing.

4. The system of claim 2, wherein the display driver is configured to compensate loading difference of Vcom in different regions of the display panel to compensate the Vcom impedance.

5. The system of claim 2, wherein the display driver is further configured to compensate the imperfections including display driving mode and touch sensing mode time multiplexing by compensating the duration of the original source output signal.

6. The system of claim 1, wherein the display control engine further comprises a memory controller configured to read/write the memory.

7. The system of claim 1, wherein the display control commands are iteratively received from the processor by the display controller in order to iteratively compensate the pixel data until the display patterns between two display time intervals are uniformly displayed.

8. A method of an adaptive driving compensation for enhancing display uniformity, the method comprising:

comparing, via a processor, a plurality of input data patterns of a display panel with an image data, wherein the image data is captured via an image capturing means;

generating, via the processor, display control commands based upon the comparison of the plurality of input data patterns of the display panel with the image data, wherein the display control commands are indicative of a compensation of one or more parameters associated with the display panel;

storing, via a memory, the plurality of input data patterns corresponding to N lines of the display panel, wherein the plurality of input data comprises pixel data corresponding to each N lines for each display time interval;

receiving, via a display controller, the display control commands from the processor, and pixel data associated with the plurality of input data patterns corresponding to N lines from the memory;

comparing, via the display controller, a difference between pixel data associated with a pixel of a current line, of the N lines of the display panel, and pixel data associated with a corresponding pixel of a preceding line, of the N lines of the display panel, corresponding to a current display time interval with a predefined threshold;

scanning, via the display controller, a look up table (LUT) to add a compensation value on the pixel data associated with the corresponding pixel of the current line, of the N lines of the display panel based upon the display control commands if the difference between the pixel data associated with each pixel of the current line and the pixel data associated with the corresponding pixel of the preceding line is greater than the predefined threshold or otherwise retain the original value of the said pixel data; and displaying, via the display panel, the input data patterns corresponding to the current line, wherein each input pattern corresponding to the current line being displayed comprises the pixel data with the compensated value or the original value;

wherein the one or more parameters comprises an amplitude of an original source output signal; and the method further comprises: compensating imperfections including display driving mode and touch sensing mode time multiplexing by compensating the amplitude of the original source output signal.

9. The method of claim 8, wherein the one or more parameters further comprises a Gate-In-Panel (GIP) timing, a Multiplexer (MUX) timing, a common voltage (Vcom) impedance, and a duration of the original source output signal.

10. The method of claim 9, wherein the GIP timing and the MUX timing are compensated by adjusting an effective "Thin Film Transistor (TFT) ON time" per row.

11. The method of claim 9, wherein the Vcom impedance is compensated by compensating loading difference of Vcom in different regions of the display panel.

12. The method of claim 9, further comprising compensating the imperfections including display driving mode and touch sensing mode time multiplexing by compensating the duration of the original source output signal.

13. The method of claim 9, wherein the display control commands are iteratively received from the processor by the display controller in order to iteratively compensate the pixel data until the display patterns between two display time intervals are uniformly displayed.

* * * * *